US005351865A

United States Patent [19]

Szadkowski et al.

[11] Patent Number: 5,351,865

[45] Date of Patent: Oct. 4, 1994

[54] APPARATUS FOR THE CONVEYING AND EXCHANGING OF A POURING TUBE

[75] Inventors: Stanislav Szadkowski, Marly, Switzerland; Stanislav Knapik, Mons, Belgium

[73] Assignee: International Industrial Engineering S.A., Belgium

[21] Appl. No.: 989,001

[22] PCT Filed: Jun. 20, 1991

[86] PCT No.: PCT/BE91/00039

§ 371 Date: Mar. 2, 1993

§ 102(e) Date: Mar. 2, 1993

[87] PCT Pub. No.: WO92/00822

PCT Pub. Date: Jan. 23, 1992

[51] Int. Cl.[5] ..... B22D 41/56

[52] U.S. Cl. ..... 222/607; 266/236

[58] Field of Search ..... 222/591, 606, 607, 594, 222/597; 266/236, 287

[56] References Cited

U.S. PATENT DOCUMENTS

| | | | |
|---|---|---|---|
| 4,220,271 | 9/1980 | Szadkowski | 222/607 |
| 4,222,505 | 9/1980 | Daussan et al. | 222/607 |
| 4,658,994 | 4/1987 | Fricker | 222/607 |
| 4,669,528 | 6/1987 | Szadkowski | 222/594 |
| 4,693,401 | 9/1987 | Nishimura et al. | 222/607 |
| 4,819,841 | 4/1989 | Stangl | 222/607 |

FOREIGN PATENT DOCUMENTS

| | | |
|---|---|---|
| 192019 | 8/1986 | European Pat. Off. . |
| 2065592 | 7/1971 | France . |
| 2424085 | 11/1979 | France . |

*Primary Examiner*—Scott Kastler

*Attorney, Agent, or Firm*—Merchant, Gould, Smith, Edell, Welter & Schmidt

[57] ABSTRACT

A device (1) for inserting and replacing an insertable pouring tube (2) having a movable plate (3) and sliding on guide rails (9), which transmit thrust upwards, comprises a tilting member (20) which engages a lever (26) to impart a tilting motion to the movable plate (3) about a horizontal front edge thereof which engages a sealing area surrounding the pouring opening of a reference plate. This tilting motion makes the movable plate (3) completely parallel with the underside of the upper reference plate (6), improves the sealing contact between the two plates and prevents any infiltration of metal therebetween.

6 Claims, 8 Drawing Sheets

APPARATUS FOR THE CONVEYING AND EXCHANGING OF A POURING TUBE

BACKGROUND OF THE INVENTION

1. Field of the Invention

The present invention relates to an improved apparatus for the conveying and exchanging of a pouring tube for a vessel for pouring molten metal from the bottom, in which a movable sealing plate and/or a replacement pouring tube attached to a movable plate is/are placed side by side by a common transverse edge next to a movable plate carrying a pouring tube to be replaced, or against a sealing plate to be moved away from the pouring gate, said movable replacement plate and said plate which is to be replaced being mounted to slide on guides which are suitable to transmit an upward pressure and to guide the displacement by transferring the plates and the pouring tubes parallel to each other under the action of a pneumatic jack in a direction perpendicular to the axis of the pouring gate, from a loading position to a working position in the axis of the pouring gate of the vessel, and from the working position to a clearing position, so as to permit the exchanging of the tube without raising the vessel.

It is mainly used in iron smelting in plants for continuous casting in order to place interchangeable pouring tubes in position, in alignment with the axis of the pouring gate of a metallurgical vessel, below said vessel.

The pouring tubes, which are intended to guide the molten metal into a mould or ingot mould hole, are heavily stressed wearing parts. This is the case to the point where their service life restricts the pouring time.

2. Description of the Prior Art

From EP-A-0192019, (U.S. Pat. No. 4,669,528) an apparatus for the conveying and exchanging of a pouring tube is known, having a detachably fitted plate for an iron-smelting or metallurgical vessel which can be sealed at the bottom by means of a stopper rod or by a sliding gate.

The conveying and exchanging apparatus comprises a movable refractory plate which can slide, under the action of a jack, along an upper reference plate, from a loading position into a working position or a sealing position, in alignment with the axis of the pouring gate.

The guide rails push the movable plate, in tight contact, against the upper reference plate under the effect of an upward pressure transmitted by a first extremity of levers on which helical springs act downwards on an opposite extremity, which springs are supported on the frame of the conveying and exchanging apparatus.

The guide rails are parallel to one another and are arranged at a slight inclination at an angle of 5° to 10° relative to the plane of reference. An apparatus of this kind readily permits the replacement of a pouring tube having a movable refractory detachable plate without raising the header.

A double-action pneumatic jack ensures the linear displacement of the movable plate bearing the pouring tube. The replacement tube is conveyed, by pivoting about a substantially horizontal axis, to the mould or the ingot mould hole, so as to permit exchanging the pouring tube without having to raise the header.

In said known apparatus, the movable plate which is intended to slide along a rectilinear path along the upper reference plate forms, relative to said upper reference plate, an inclined surface, the pitch of which is determined by the slope of the path of the guide rails.

The pitch of the guide rails relative to the reference plane of the upper plate makes it possible to obtain a gradual securing of the movable plate attached to the pouring tube when the latter is brought into alignment with the pouring opening, but it has the disadvantage that the joint between the two plates in the vicinity of the pouring gate opening is not tight. In fact, the parallelism between the bottom plate and the movable plate bearing the pouring tube is not perfect at the time of the engagement of the movable plate in the sealing zone surrounding the pouring gate opening. Liquid metal can penetrate between the upper reference plate and the movable plate. When hardening, the metal which has penetrated forms a crust which changes the evenness of the contact surfaces and gives rise to the danger of jamming of the movable plate and to be a cause for the non-sealing of a contact zone of the two plates in the immediate vicinity of the pouring opening.

SUMMARY OF THE INVENTION

The present invention seeks to remedy this disadvantage and, to this end, proposes an apparatus which makes it possible to ensure the parallelism of the movable replacement plate and the upper reference plate, from the time of re-covering the pouring gate by said movable plate conveyed into the immediate vicinity of the pouring opening by a pneumatic jack.

The conveying and exchanging apparatus for a pouring tube is as described in the first paragraph above. Said apparatus is characterized in that it comprises means to provide the movable plate with a rocking movement about a frontal horizontal ridge of the movable plate engaged in the zone adjacent to the pouring opening, in a manner so as to render the movable plate strictly parallel to the lower face of the upper plate. This rocking movement permits tight contact between the movable plate and the upper plate and prevents any leakage of liquid metal when the pouring tube is exchanged or during the sealing of the pouring opening by a movable sealing plate.

According to a particular feature of the invention, the means intended to provide the movable plate with a rocking movement comprise a lever which acts in an upward direction on a rear portion of the movable plate opposite the frontal ridge engaged in the sealing zone surrounding the pouring opening of the reference plate.

In a first characteristic embodiment of the invention, the lever is a part of the guide rail fastened, by one extremity which is spaced away from the pouring gate, to a rocker arm comprising a crank-pin hinged about a horizontal shaft, against which bears a piston which is resisted by a helical spring when the piston is released by a double-action pneumatic jack which is intended to make the movable plate slide along the guide rails.

In a second characteristic embodiment of the invention, the rocker arm comprises a first arm which is secured in a direction normal to the surface of a cylindrical ring mounted on a horizontal shaft, about which is coiled a torsion spring, which is secured, by a first extremity, in the ring and, by a second extremity, in a stationary frame of the conveying apparatus, the ring being displaced angularly about the shaft in opposition to the spring under the action of a thrust exerted by the double-action jack on a second arm which extends perpendicularly relative to the first arm in a radial plane of the cylindrical ring. These features and details of the invention, as well as others, will appear from the following detailed description, in which reference is made to the attached drawings. Said drawings illustrate two embodiments of the invention, given by way of illustrating and non-restricting examples.

BRIEF DESCRIPTION OF THE DRAWINGS

In the drawings.

In these drawings, the same reference numbers are used to designate identical or similar components.

DETAILED DESCRIPTION OF THE PREFERRED EMBODIMENT

Figure 1:
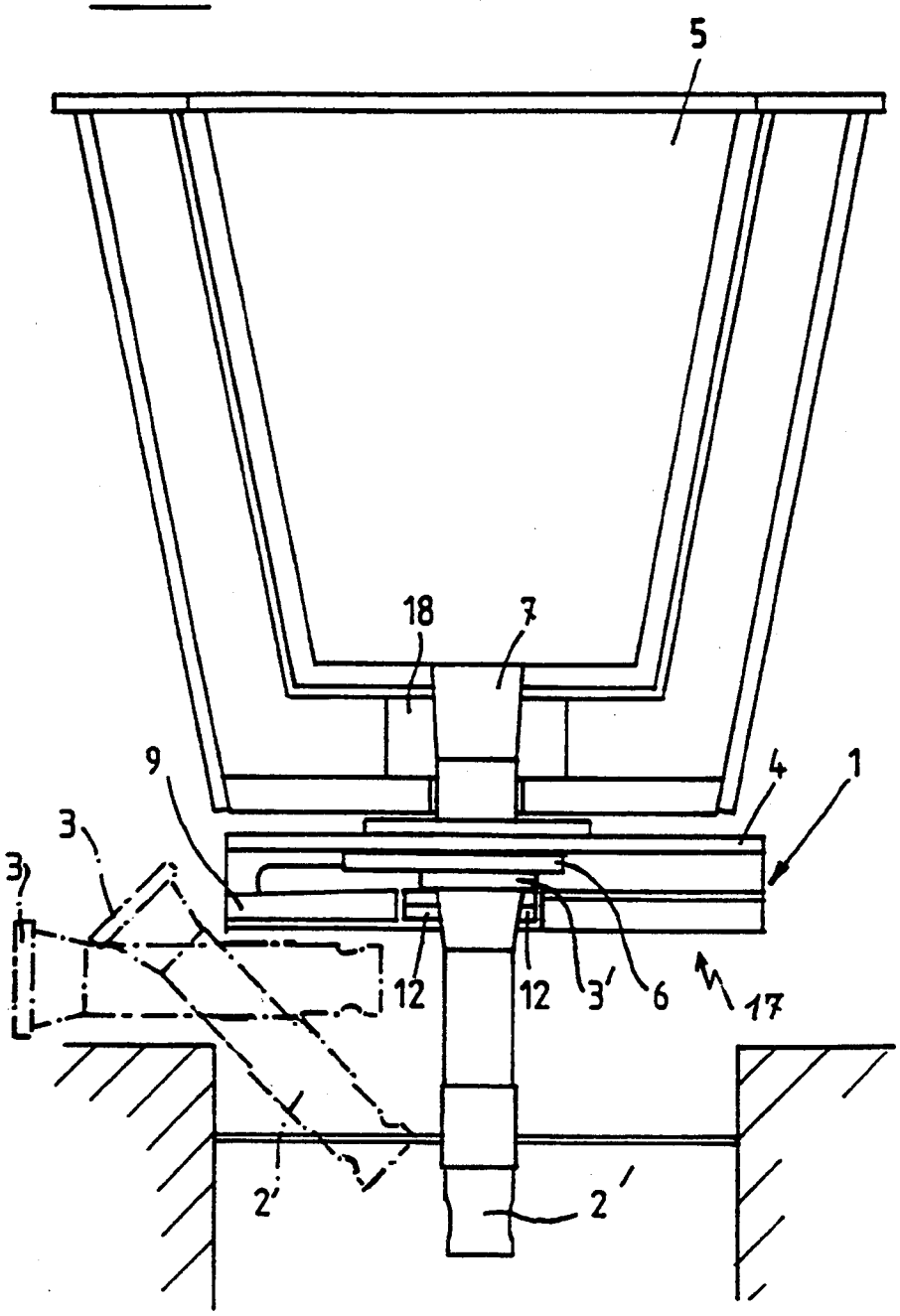
FIG. 1 shows an end view of a conveying and exchanging apparatus according to the invention for a pouring tube arranged below the casting vessel.

FIG. 1 shows an apparatus, according to the invention, for the conveying and exchanging of a pouring tube, which apparatus is designated in its entirety by reference number 1 and is mounted below a pouring header 5 in the vicinity of the pouring gate 7.

Figure 2:
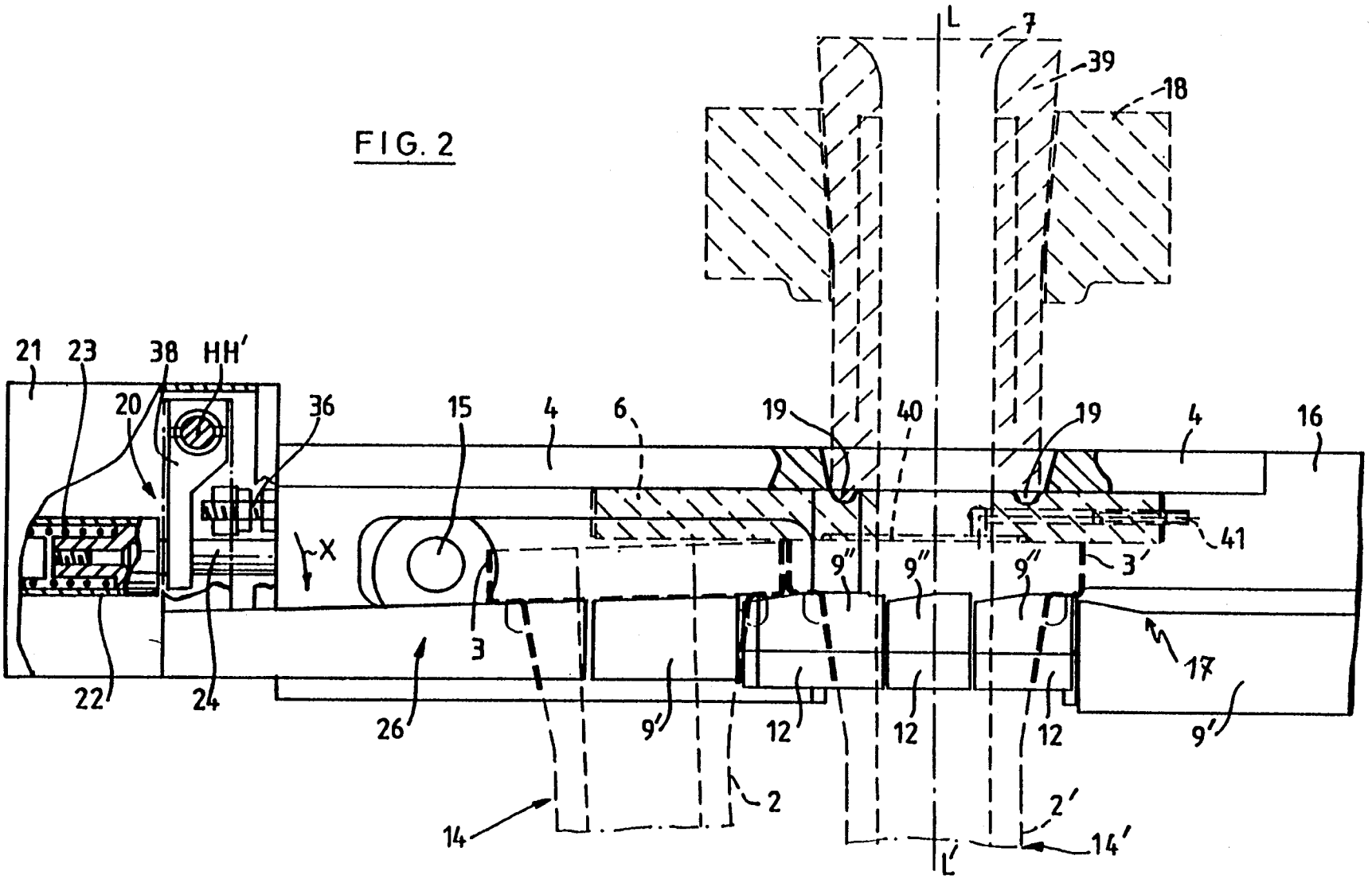
FIG. 2 shows a view of a side elevation on an enlarged scale of the conveying and exchanging apparatus shown in FIG. 1, showing a guide rail in a loading position.

The header may, possibly, already be provided with a sliding-gate device. The closing device is, generally, simply a stopper-rod (not shown). The apparatus 1 is intended to permit the conveying of a standby pouring tube 2, which is attached to a movable plate 3, into a loading position 14, and the replacement of a worn tube 2', which is attached to a movable plate 3', into a working position 14' (FIG. 2).

The pouring tubes 2, 2', each of which is connected to a movable plate 3, 3', slide along an upper reference plate 6 which abuts below the pouring header 5 against an internal nozzle 39 which is maintained in position by a seating block 18. The seal between the internal nozzle 39 and the reference plate is ensured by a sealing collar 19.

The upper reference plate 6 is possibly composed of a plurality of independent refractory members. The refractory member surrounding the pouring gate is possibly provided, on a lower face about a pouring opening 27, with a groove 40 which is connected to a supply pipe 41 of argon.

Two guide rails 9 run at an inclination relative to the reference plate 6.

In a manner known per se, as described in EP-A-0192019, the guide rails 9 are divided into two fixed rail sections 9' which are integral with a frame which is to be mounted below the pouring header 5 in the vicinity of the pouring gate 7, and three movable rail sections 9'', which are disposed between the respective two fixed rail sections in their common longitudinal extension.

The movable guide rail sections 9'' are each mounted at the extremity of a lever which pivots about an axis AA'. Each lever is subjected at its opposite extremity to the action of a spring 10 which, when pushing this opposite extremity in a downward direction, pushes the movable rail sections upwards.

The pressure exerted by the movable guide rails 9'' on each of the movable plates associated with the pouring tube 2 which is being displaced along said fixed guide rails 9' and said movable guide rails 9'' increases progressively as said plates approach the pouring gate 7.

The pitch of the guide rails 9 is such that there is a gradual securing of the movable plate 3 of a pouring tube 2 against the upper reference plate 6 when any one of the pouring tubes 2, 2' is close to the pouring gate 7. This securing decreases when the movable plate 3 moves away therefrom, permitting the easy withdrawal of said plate into a clearing position 17 away from the pouring gate 7.

During the engagement of the movable plate 3 in the sealing zone surrounding the pouring gate 7, the movable plate 3 rests on the guide rails 9 and is, relative to the upper reference plate 6, at an inclination which is relatively slight but sufficient to be the cause of penetration of liquid metal between the upper reference plate 6 and the movable plate 3.

The movable plate 3, although pushed upwards against the upper reference plate 6, under the thrust of the levers 12, 12' which are each subjected to the action of the springs 10, 10' disposed at a sufficient distance from the pouring gate 7 so as to protect them against the intense heat of the molten metal, does not ensure a perfect sealing as long as the parallelism of the movable plate 3 and the upper reference plate 6 is not ensured.

Figure 3:
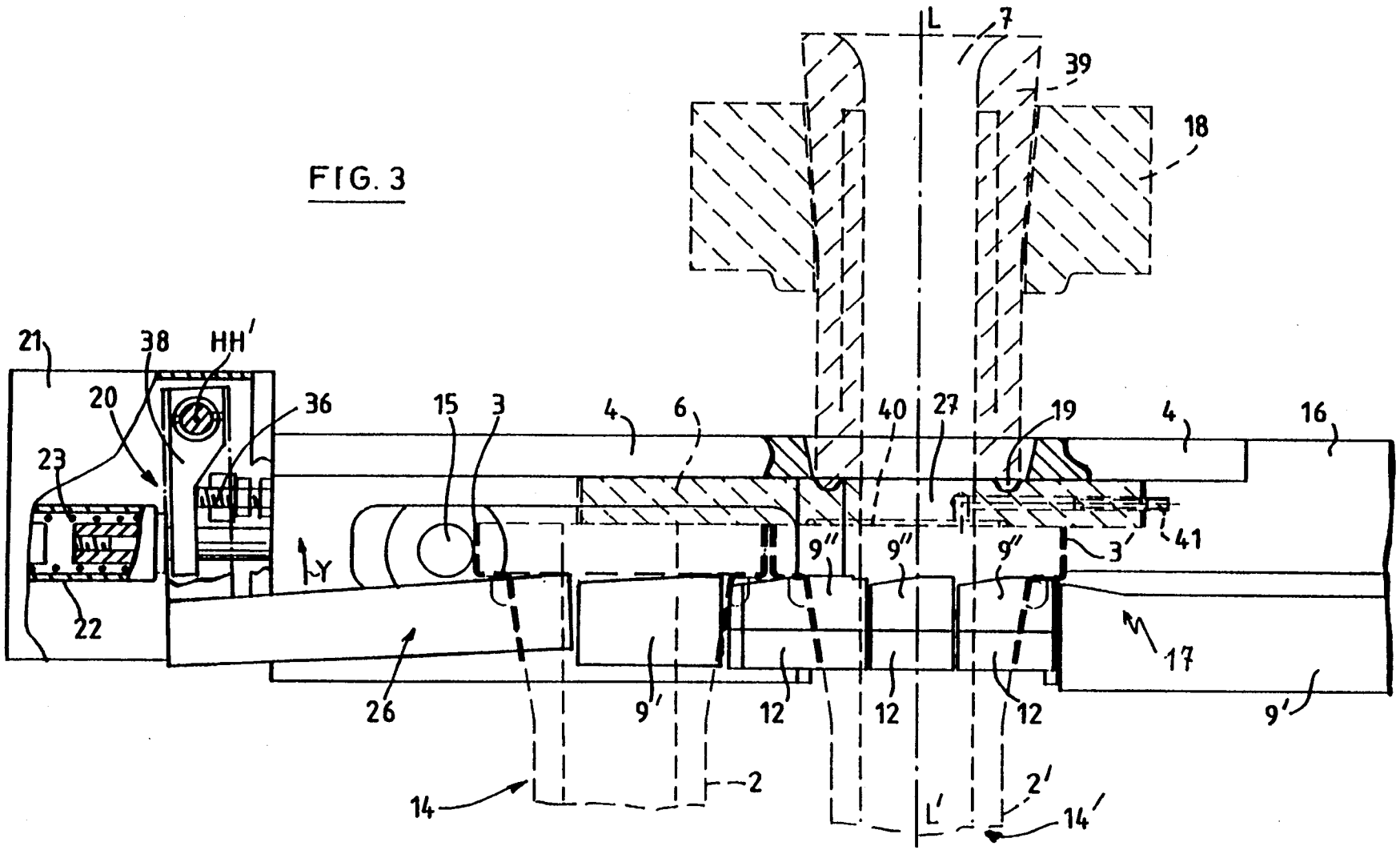
FIG. 3 shows a view of a side elevation which is analogous to that of FIG. 2, comprising a guide rail in a raised position.

It is only at the end of the operation of conveying and loading the pouring tube 2 that the parallelism of the plates is perfect and the force exerted by the guide rails 9 on the movable plate attached to the pouring tube 2', which is being displaced along said rails 9, is sufficient, since it increases gradually as the movable plates approach the pouring gate 7. This upward thrust pushes the movable plates 3 and 3' of the worn pouring tube 2' and of the standby tube 2 against the sliding plane of the reference plate 6 in a sealing manner only at the moment when the opening provided in the movable plate 3' is in alignment with the axis LL' of the pouring gate 7 (FIG. 3).

Figure 4:
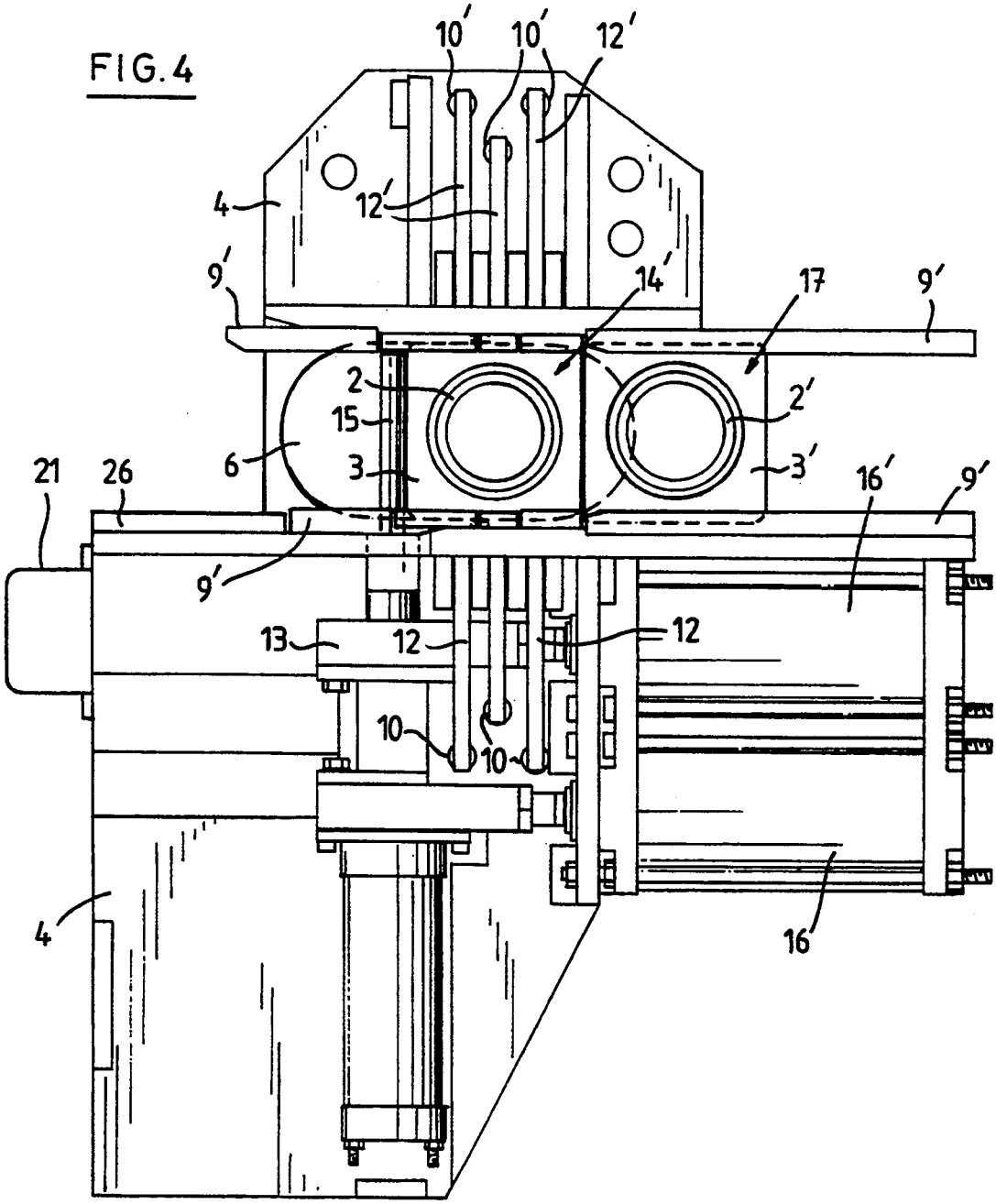
FIG. 4 shows a view from below of the conveying apparatus illustrated in FIG. 3.

As illustrated in FIG. 4, the linear displacement of the movable plates 3, 3' is ensured by a retractable pusher arm 15 which is actuated by a pair of pneumatic jacks 16, 16' which are disposed in parallel in order to provide the force required to permit a rapid loading of the pouring tube 2, making optimal use of the little space available as far as the height is concerned. The rods 11 and 11' of the jacks 16 and 16' are interconnected by a mobile slide 13 supporting the retractable pusher arm 15.

The apparatus according to the invention aims to ensure the parallelism between the movable plate 3 and the upper reference plate 6 from the commencement of the operation to convey and load the standby pouring tube 2.

To this end, the apparatus according to the invention comprises a rocker arm 20. The rocker arm 20 comprises a casing 21 which is firmly attached to the frame 4 of the apparatus for the conveying and loading of the pouring tube, in the longitudinal extension of one of the push jacks 16, 16', preferably of the jack 16', being the closest to the guide rails 9 of the conveying apparatus.

The casing 21 shields a cylindrical case 22 in which is disposed a helical spring 23 which is compressed under the action of a piston head 24 which is subjected to the pressure of the double-action pneumatic jack 16, 16' which is intended to cause the sliding of a movable plate 3 along the guide rails from the loading position 14 into the working position 14'.

Figure 5:
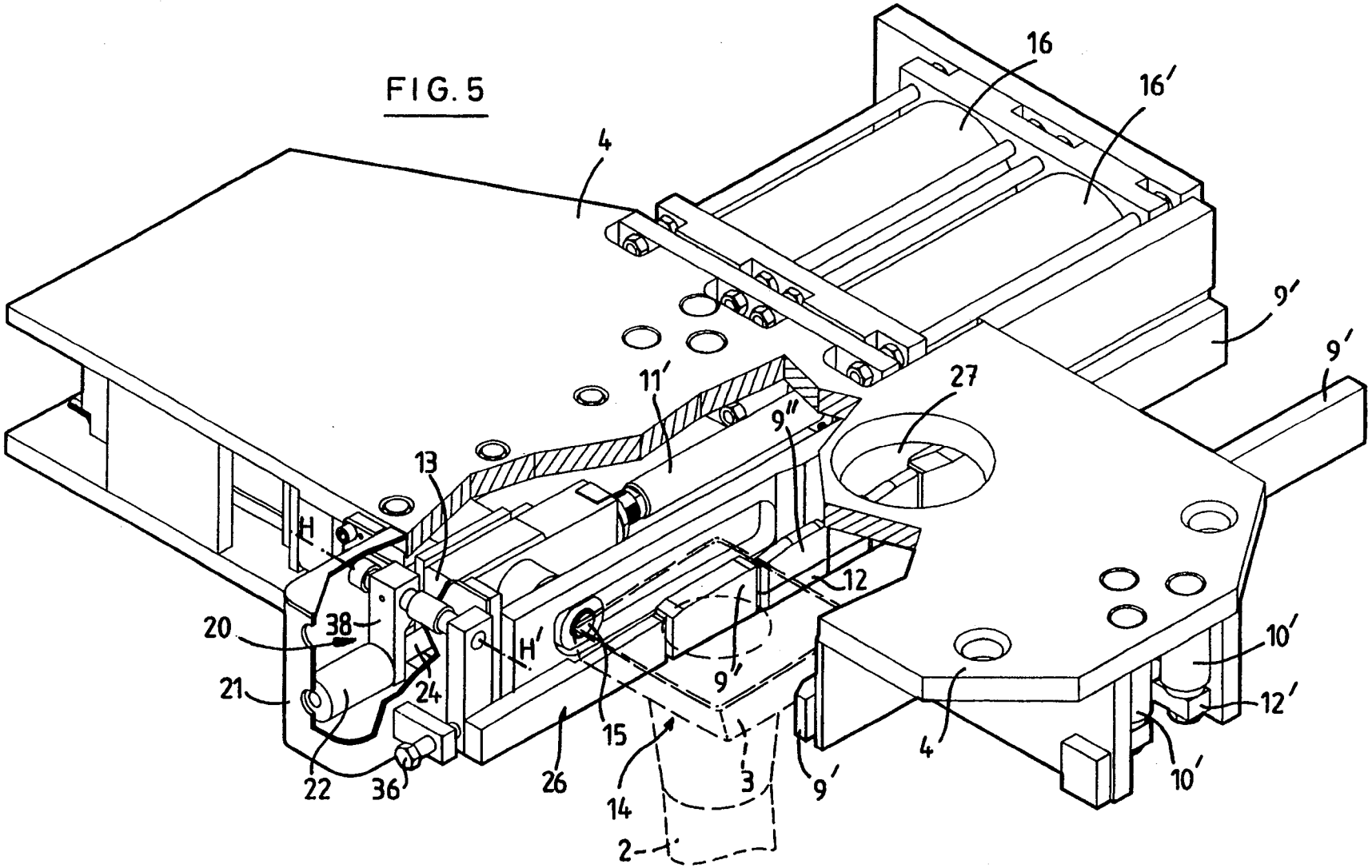
FIG. 5 shows a view in perspective, partially stripped, of the conveying and exchanging apparatus shown in FIG. 2, provided with a first embodiment of a rocker arm according to the invention, shown in its lower waiting position.

Prior to introducing a new pouring tube 2 into the conveying and loading apparatus, the double-action pushing jack 16, 16' is released which then, in the extended position, abuts against the piston head 24 of the rocker arm 20. The piston head 24 of the rocker arm 20 compresses the helical spring 23 in the case 22 and permits a crank-pin 38, which is connected to an elbow lever 26, to pivot about a horizontal axis HH' and to lower the lever 26 into a loading position substantially horizontally in the longitudinal extension of the slight inclination of the guide rails 9. (FIG. 5).

Figure 6:
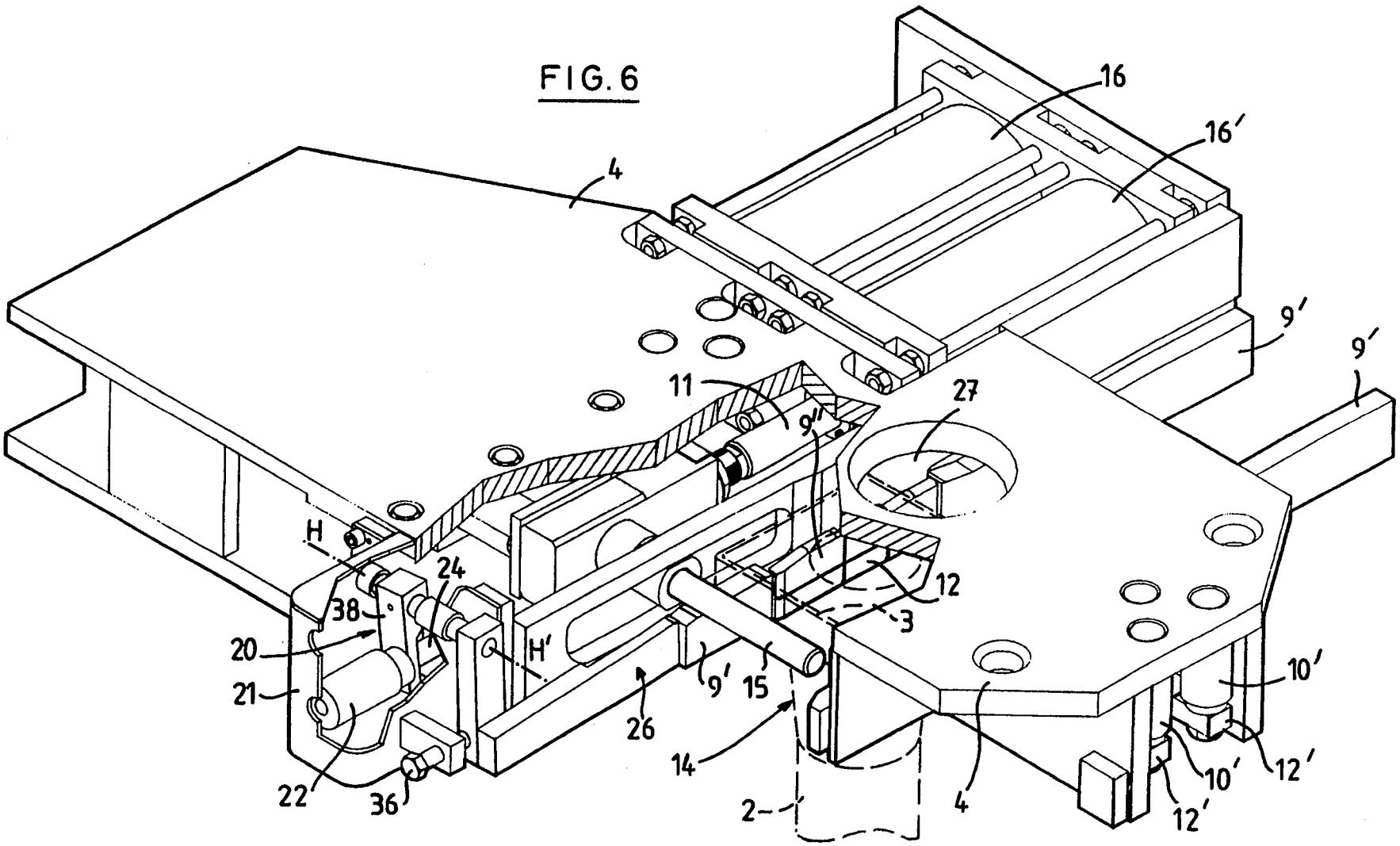
FIG. 6 shows a view in perspective of the apparatus shown in FIG. 1, the rocker arm having actuated the guide rail into the raised position.

During the conveying of the tube from the loading position 14 to the working position 14' in the axis of the pouring gate 7, under the action of the double-action jack 16, 16', the latter moves away from the rocker arm 20 and releases the piston rod 24 of the rocker arm 20. The piston rod 24 is pushed back by the helical spring 23 against a stop screw 36 of the lever 26 which pivots through a fraction of a turn about the horizontal shaft HH' of the rocker arm 20 such as to raise the elbow lever 26 upwards (FIG. 6).

The raising of the elbow lever 26 imparts to the movable plate a rocking movement about a horizontal frontal ridge of the movable plate introduced into the sealing zone surrounding the pouring opening 27. This rocking movement causes the movable plate 3 to be strictly parallel with the lower face of the upper reference plate 6 (FIG. 6).

The apparatus horizontally conveys the movable plate 3, by raising that part of the movable plate which is most distant from the pouring opening 27, immediately after having placed the pouring tube 2 attached to the movable plate in the loading position 14, prior to or while the movable plate 3 slides into a working position 14' in alignment with the casting axis LL' of the pouring gate 7.

The rocking movement has the advantage that it permits the movable plate 3 to be pressed, in a tight manner, against the upper reference plate 6 during the transfer under the action of the pneumatic jacks 16, 16', during changing of the tube. It permits the prevention of any leakage of liquid metal between the movable plate 3 and the upper reference plate 6 when commencing the operation of changing the tube.

Figure 7:
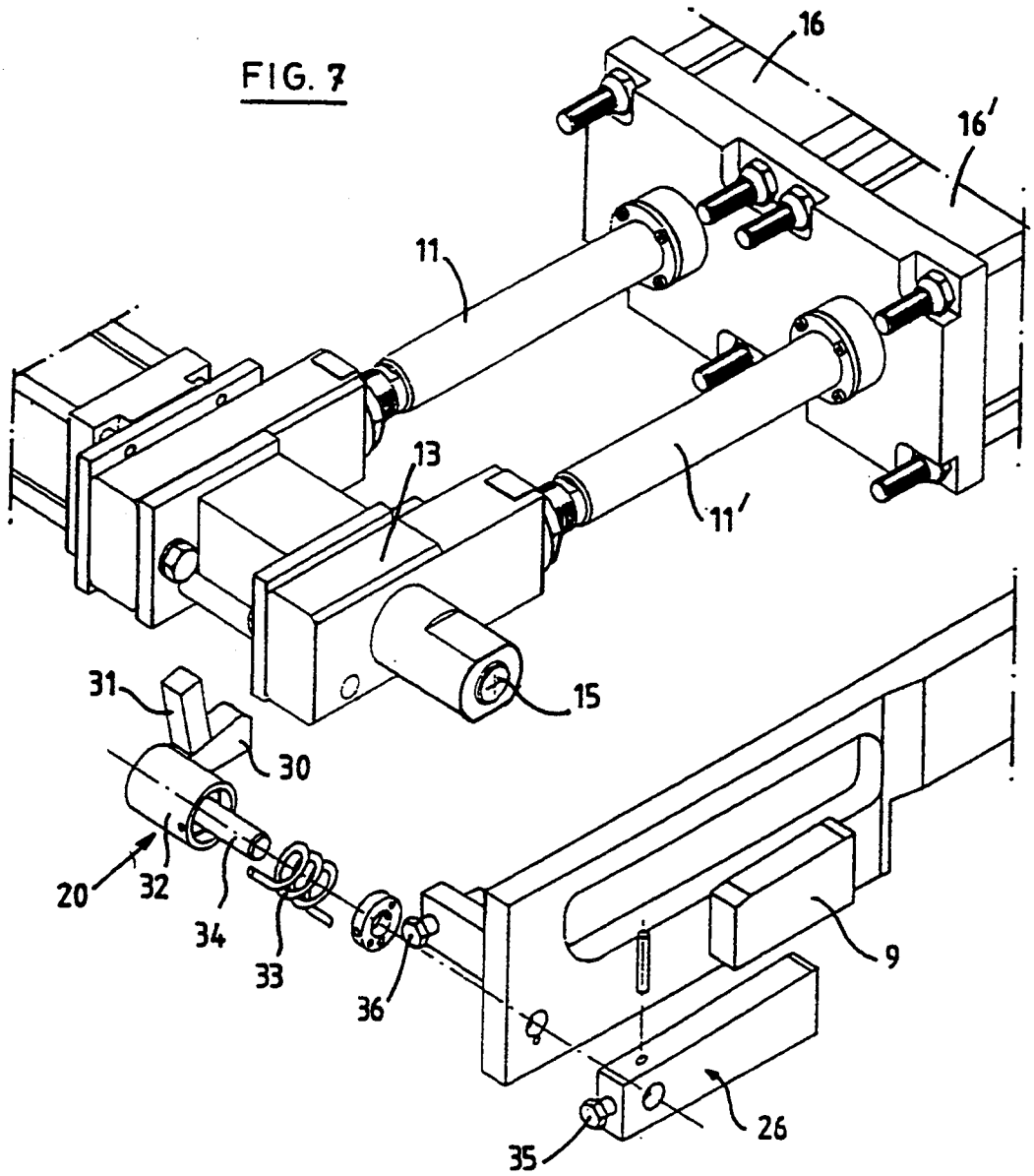
FIG. 7 shows an exploded view in perspective of a second embodiment of a rocker arm according to the invention.

A second embodiment of the apparatus for the conveying and loading of a pouring tube 2 is illustrated in FIG. 7. It comprises a rocker arm 20 having two arms 30 and 31: a first arm 30 is a lever which extends in a direction normal to the surface of a cylindrical ring 32, and the second arm 31 is an attachment which extends in a direction tangential to the surface of the ring 32, i.e. in a radial plane of the ring 32, and perpendicularly relative to the lever 30. The cylindrical case 32 shields a torsion spring 33, the ends of which are anchored in the ring 32 and in the frame 4 of the conveying apparatus.

Figure 8:
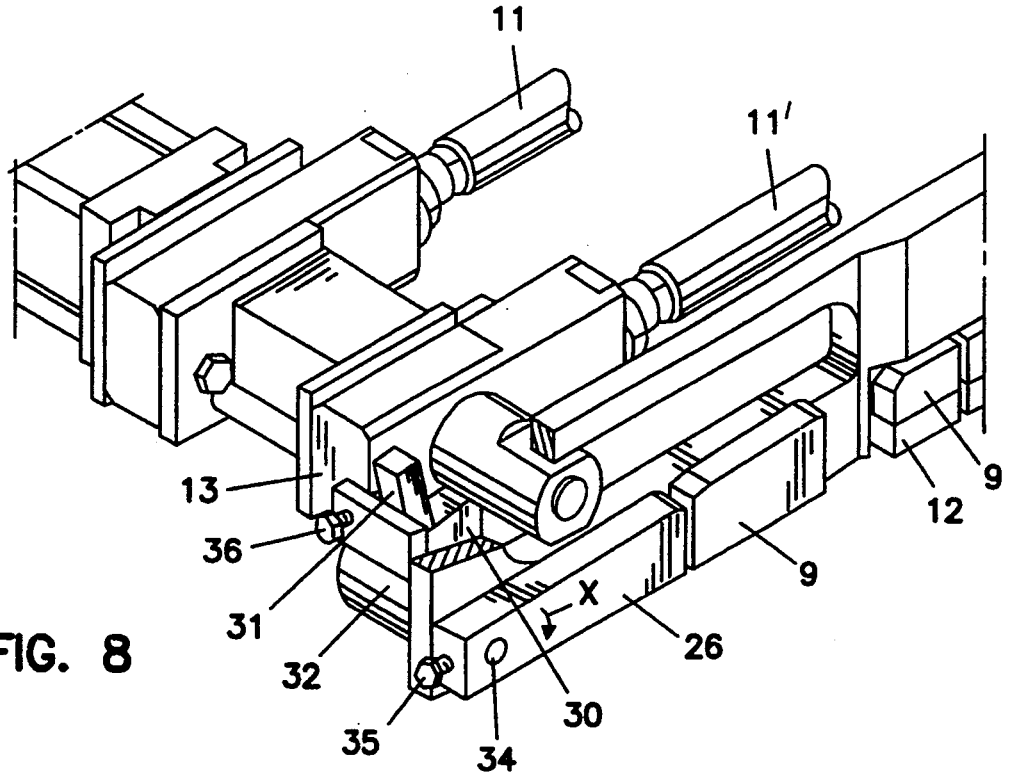
FIG. 8 shows a view in perspective, partially stripped, of the rocker arm illustrated in FIG. 5, disposed in a lower position.

The head of the double-action pneumatic jack 16, 16' pushes the first arm 30 back downwards against the resistance of the torsion spring 33 and, by pivoting about the shaft 34 in the direction of the arrow X, brings a lever 26 downwards to a position in which the introduction of a new pouring tube 2 is readily possible. The lever 26 is locked on the shaft 34 by means of a screw 35 (FIG. 8).

Figure 9:
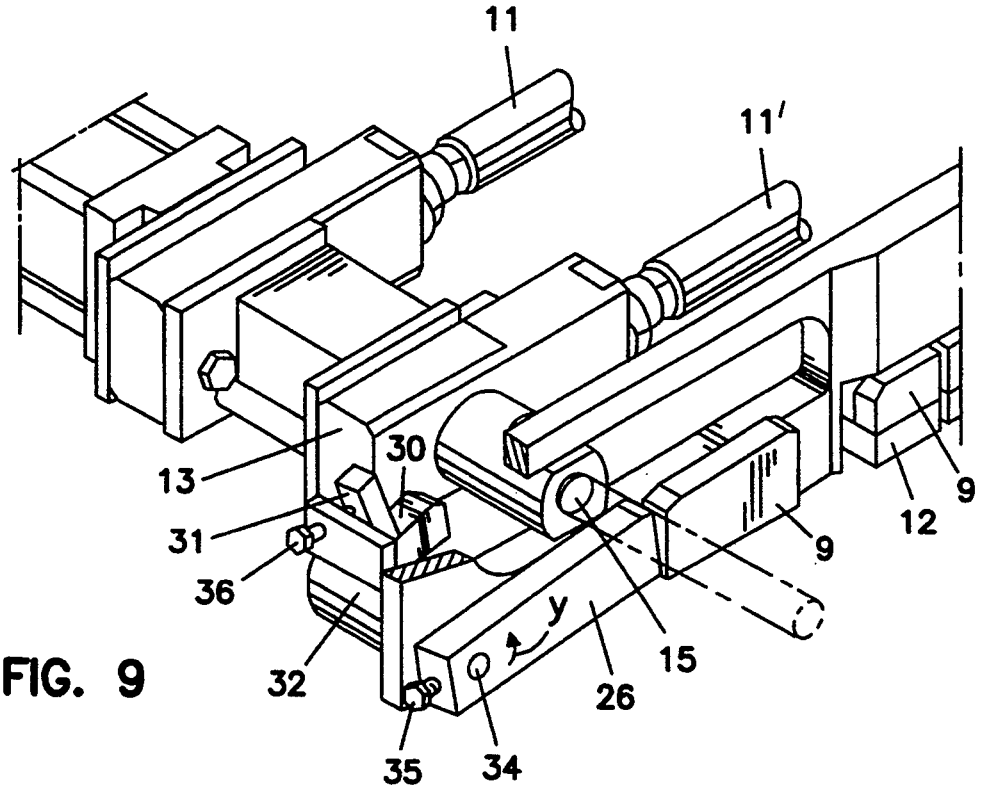
FIG. 9 shows a view in perspective similar to that of FIG. 6, illustrating the rocker arm in a raised position.

During engagement of the new pouring tube 2 by linear displacement towards and into the sealing zone surrounding the pouring opening 27 of the reference plate 6, the double-action jack 16, 16' moves away from the ring 32 and releases the first arm 30 which, under the action of the torsion spring, pivots at the same time as the second arm 31 and the lever 26 in the direction of the arrow Y. The pivoting movement of the second arm 31 is limited by the stop screw 36 (FIG. 9). While pivoting, the lever 26 causes the upward displacement of a rear portion of the movable plate 3, opposite the frontal ridge already engaged in the sealing zone surrounding the pouring opening 27. This rocking movement of the movable plate 3 about its frontal horizontal ridge causes the plate 3 to be strictly parallel to the upper reference plate 6 and improves the tightness between the parts of the contact surface of the two above-mentioned plates.

We claim:

1. An apparatus for conveying and exchanging a pouring tube for pouring molten metal from the bottom of a vessel (5) in which a replacement pouring tube (2) attached to a first movable plate (3) located in a loading position (14) is adjacent to a second movable plate (3') carrying a worn pouring tube (2') to be replaced, the vessel (5) having a pouring gate (7) and an upper reference plate (6) with a pouring opening (27), the pouring gate (7) and the pouring opening (27) defining a pouring axis (L,L'), the upper reference plate (6) having a lower face for forming a sealing zone with the movable plates (3,3'), the second movable plate (3') being engaged with a lower face of the upper reference plate (6) in a working position (14'), said first movable plate (3) and said second movable plate (3') being mounted so as to slide parallel on guide rails (9) under the action of a pneumatic Jack (16, 16') in a direction perpendicular to the pouring axis (L, L'), the guide rails being suitable to transmit upward pressure and to guide the displacement by transferring the first movable plate (3) and the replacement pouring tube (2) from the loading position (14) to the working position (14') in the axis (L, L') of the pouring gate (7) in the vessel (5), and the second movable plate (3') and the worn pouring tube (2') from the working position (14') to a clearing position (17), so as to permit the exchanging of the tube (2,2') without raising the vessel (5), comprising a rocker arm (20) which sets a lever (26) in action between a bottom loading position and a raised working position so as to impart to the first movable plate (3) a rocking movement about a frontal transverse edge of the movable plate engaged in the sealing zone surrounding the pouring opening (27) so that the movable plate (3) is strictly parallel to the lower face of the upper reference plate (6) during movement from the loading position (14) to the working position (14').

2. The apparatus according to claim 1 wherein the rocker arm (20) causes the lever (26) to pivot through a fraction of a turn such that in the working position the lever (26) acts upwards on a rear portion of the first movable plate (3) opposite the frontal ridge engaged in the sealing zone surrounding the pouring opening (27) of the reference plate (6).

3. The apparatus according to claim 1 wherein the lever acts in the lower loading position in a longitudinal extension in the guide rails (9).

4. The apparatus according to claim 3 wherein the lever (26) is firmly fastened by an extremity spaced away from the pouring gate (7) to a rocker arm comprising a crank-pin (38) which is hinged about a horizontal shaft (H, H′), the crank-pin co-operating with a piston (24) which is pushed back by a helical spring (23) when the piston (24) is released by a double-action pneumatic Jack (16, 16′) which moves the movable plates (3, 3′) along guide rails (9).

5. The apparatus according to claim 2 wherein the rocker arm (20) comprises a crank-pin (38) which is connected to an elbow lever (26), the lever pivoting about a fixed horizontal axis (H, H′), the lever (26) being actuated by the crank-pin (38) angularly displaced through a fraction of a turn under the action of a double-action pneumatic jack (16, 16′) which causes the second movable plate (3′) to slide along guide rails (9) from the working position in which the lever (26) acts upwards on a rear portion of the second movable plate (3′) opposite the frontal ridge engaged in a sealing zone surrounding the pouring opening (27), to a lower position for the loading of a replacement tube (2) in opposition to a helical spring (23) which takes the lever (26) to the working position when the lever (26) is released by the double-action jack (16, 16′).

6. The apparatus according to claim 4 wherein the rocker arm (20) comprises a first arm (30) which is firmly attached in a direction normal to the surface of a cylindrical ring (32) which is mounted on a horizontal shaft about which is coiled a torsion spring (33) which is firmly attached, by a first extremity, in the ring (32) and, by a second extremity, in a stationary frame (4) of the conveying apparatus, the ring being displaced angularly about the shaft in opposition to the torsion spring (33) under the action of the pressure exerted by the double-action Jack (16, 16′) on a second arm (31) which extends perpendicularly relative to said lever (26) in a radial plane relative to the cylindrical ring (32).

* * * * *

UNITED STATES PATENT AND TRADEMARK OFFICE
CERTIFICATE OF CORRECTION

PATENT NO. : 5,351,865

DATED : October 4, 1994

INVENTOR(S) : Szadkowski, et al.

It is certified that error appears in the above-identified patent and that said Letters Patent is hereby corrected as shown below:

In claim 1, column 6, line 49, "Jack" should be --jack--.

In claim 4, column 7, line 18, "Jack" should be --jack--.

In claim 6, column 8, line 22, "Jack" should be --jack--.

Signed and Sealed this

Thirty-first Day of October 1995

*Attest:*

*Attesting Officer*

BRUCE LEHMAN

*Commissioner of Patents and Trademarks*